United States Patent [19]

Wilson

[11] 4,425,391

[45] Jan. 10, 1984

[54] BUTTON AND BUTTONHOLE TAPE

[76] Inventor: Barbara J. Wilson, 14635 Bainbridge, Livonia, Mich. 48154

[21] Appl. No.: 75,698

[22] Filed: Sep. 14, 1979

[51] Int. Cl.[3] ..... D05B 3/06

[52] U.S. Cl. ..... 428/43; 2/265; 2/266; 112/152; 112/153; 112/264.1; 428/102; 428/187; 428/195; 428/343; 428/906

[58] Field of Search ..... 428/43, 187, 195, 207, 428/211, 343, 102, 906; 2/243 B, 265, 266; 112/136, 152, 153, 264.1

[56] References Cited

U.S. PATENT DOCUMENTS

| | | | |
|---|---|---|---|
| 1,668,519 | 5/1928 | Smith | 112/407 |
| 2,342,569 | 2/1944 | Bernstein | 2/266 |
| 2,713,686 | 7/1955 | Oster et al. | 2/206 |
| 3,221,427 | 12/1965 | Kaplan | 428/43 X |
| 3,794,554 | 2/1974 | Caring | 428/43 |
| 3,936,944 | 2/1976 | Byne | 428/906 |

*Primary Examiner*—Bruce H. Hess
*Attorney, Agent, or Firm*—Frank H. Cullen

[57] ABSTRACT

An improved tape for use in locating buttons and the corresponding buttonholes is formed of a perforated strip of fabric, paper, or plastic material with two corresponding series of locating indicia. The tape has a pressure-sensitive adhesive to adhere the strip temporarily to the fabric of a garment, and is perforated between the two sets of locating indicia.

In use, two panels of fabric to have attached buttons and to be worked for buttonholes are laid side by side, or in overlapping relationship and the tape is adhered to both panels.

The two halves of the tape are separated along the perforations, and the button and buttonhole indicia remain adhered to the panels of fabric, in perfect alignment until the sewing and working is completed.

3 Claims, 4 Drawing Figures

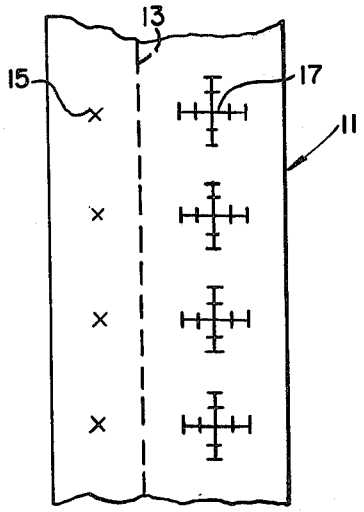
FIG. 1
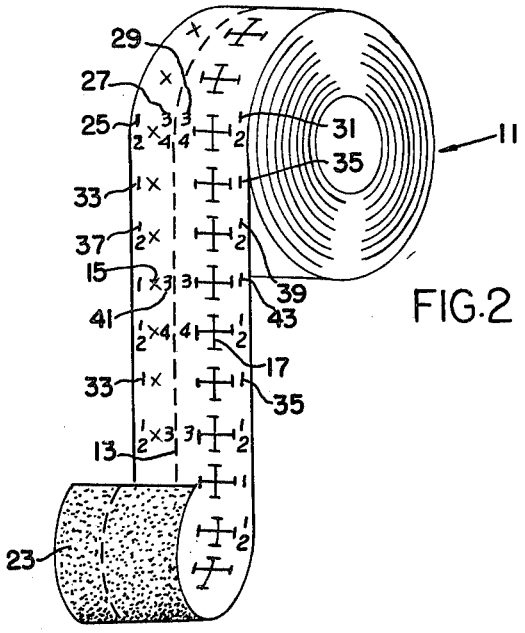
FIG. 2
FIG. 3
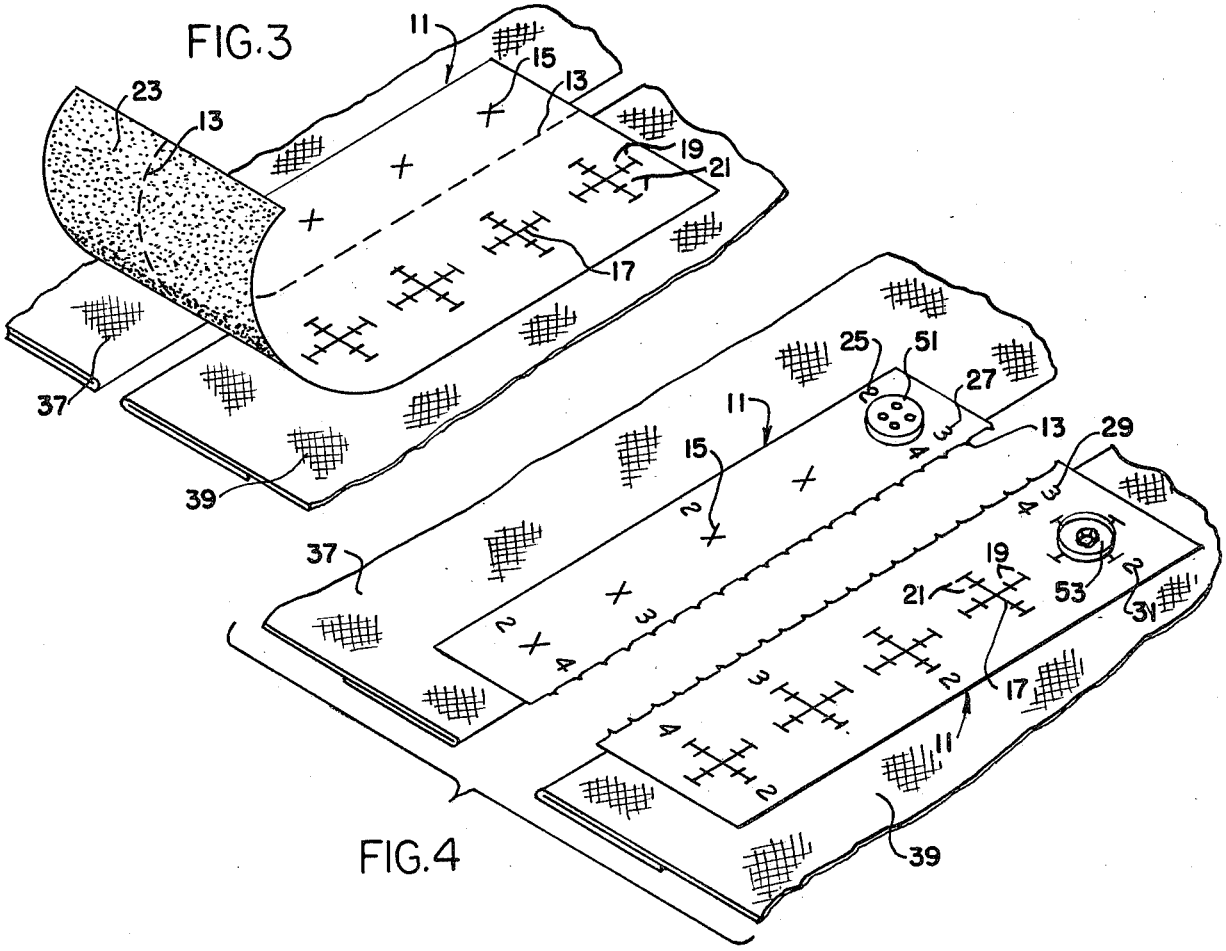
FIG. 4

BUTTON AND BUTTONHOLE TAPE

SUMMARY OF THE INVENTION

The tape of the present invention is useful for positioning buttons and buttonholes on corresponding panels of fabric, so that the buttons and buttonholes will correspond exactly when the buttons are sewed on and the buttonholes are worked. Other fasteners, such as hooks and eyes, snaps, and similar devices can be positioned for attachment to panels using the invention.

The tape itself has two sets of locating indicia, arranged on opposite sides of a longitudinal perforation, and the tape has an adhesive to adhere the tape temporarily to the panels of fabric which are to receive the buttons and buttonholes.

The locating indicia may be arranged to have spacing apart at two or more different intervals so that the buttons and buttonholes may be spaced differently for various applications, for example, at one inch, at one-and-one-half inches, and at two inches. Multiples of these spacings would give three inches, four inches, and so on.

A further feature of the invention is that the tape can be made of water-soluble strip material, or for use with material which is to be dry cleaned, the fibers of the tape can be bonded with any substance soluble in dry cleaning solvents.

DETAILED DESCRIPTION OF THE INVENTION

The button and buttonhole tape of this invention will now be described in connection with the accompanying drawing, wherein:

FIG. 1 is a view of a portion of a tape in accordance with this invention;

FIG. 2 is a perspective view of a roll of tape illustrating an alternate marking of the indicia;

FIG. 3 is a perspective view of the tape of the invention in use to position corresponding fasteners on two panels of fabric; and FIG. 4 is a perspective view showing the two panels separated, each having a portion of the tape of the invention in position to indicate the proper position for matching buttons and buttonholes.

Referring now to FIG. 1, the button and buttonhole tape is designated generally by the reference numeral 11, and the tape has a longitudinal weakened portion 13, which may be for example a perforation, running the entire length of the tape. The perforation 13 is preferably of the type which has a long cut relative to the bridging portion, in order to make the tape easy to separate along the weakened line 13.

At precisely-located intervals along the tape 11, corresponding indicia 15 and 17 are printed on the tape to position the button (on the index 15) and the buttonhole (on the index 17) on a panel of fabric. The indicia for the buttonholes 17 are shown as having markings for either vertically or horizontally oriented buttonholes, and printed length marks 19 and 21 are used to guide the seamstress or tailor to cut and work the buttonhole to the proper size for both horizontal and vertical orientation.

Referring now to FIG. 2 as well as FIG. 1, the reverse side of the tape is coated with an adhesive 23 to enable the tape to be adhered to panels of fabric which have been carefully positioned by the seamstress or tailor in side-by-side relationship. The places in the panels where the buttons and buttonholes are to be worked are spaced apart by the distance between the button indicia 15 and the buttonhole indicia 17, and the tape of the invention adhered to both panels of material. When properly adhered, the two portions of the tape are separated along the perforation 13, with the two sides and the indicia 15 and 17 firmly but temporarily adhered to the panels of fabric or material.

The locating indicia 15 and 17 may be coded by printing markings 25, 27, 29 and 31 alongside each index to indicate the spacing for fasteners for several alternative spacings available to the user. The markings 25, 27, 29 and 31, "1", "2", "3" and "4" indicate the unit measurement between adjacent buttons or fasteners.

In the markings in FIG. 2, four spacings are shown: the uppermost markings 25, 27, 29 & 31 are positioned adjacent the indicia 15 and 17 to show that those indicia 15 and 17 are used for unit spacings of 1, 2, 3, or 4 units (for example, inches or centimeters). The next indicia has only markings for spacing "1", indicated by the reference numerals 33 and 35.

The next set of indicia 15 and 17 has markings 37 and 39 for spacings "1" and "2", while the fourth set of indicia have markings 41 and 43 to indicate the proper place to attach fasteners for spacings of "1" and "3" units. This pattern may be repeated along the entire length of the tape, making one variety of tape suitable for several spacings of fasteners.

It will also be obvious to those skilled in the art that the unit "1" markings, such as at 33 and 35 may be eliminated, making the markings easier to read or enabling another set of spacings to be used as well.

FIG. 3 shows a tape of the invention in use with two panels of material 37 and 39 to position fasteners along corresponding edges of the panels for working by the user.

The two panels of fabric 37 and 39 are positioned side-by-side, with the fastener areas aligned, and are then pulled apart so that the indicia 15 and 17 are positioned the proper distance to allow the fasteners to be attached at the chosen distance from the edge of the panel. The tape 11 is then adhered to both of the panels of the fabric at the same time. Vertical and horizontal (lineal and transverse) alignment can then be checked before the tape is separated.

FIG. 4 shows the two panels 37 and 39 after they have been separated by tearing the tape along the perforations. The two portions of the tape 11 bearing the indicia 15 and 17 are adhered to the panels 37 and 39 respectively, ready for the user to attach buttons, snaps, hooks, or other fasteners.

A button, or in the more modern method of attaching fasteners, a fastener 51 with a false button face is attached by positioning the fastener over the index mark 15, and a pronged mating member is inserted through the material and into the fastener 51 from the rear and tapped into place with the proper tool to clinch the material between the two parts of the fastener. The mating fastener 53 is shown attached to the other panel 39, positioned by the index marks 17.

The tape can be removed when the buttons or fasteners are first attached or stitched, one at a time, or may be left in place until all are attached, and then peeled off.

For commercial applications, it may be preferred to have the tape left in place until not only buttons are sewn on, but also until the buttonholes are worked. In this case, it is desireable to have the tape 11 made of a plastic material of a thin gage, so that the buttonhole working on the sewing machine perforates the plastic around the hole, and the tape can be readily peeled off with no residue left on the panels 37 or 39.

My invention also contemplates making the tape of non-woven fiber material, which tape is merely held together by the sizing, making the tape disintegratible in water. This version would be most acceptable for home sewing. Alternatively, the tape can be made of material which is soluble in commonly used dry cleaning fluids, such as benzine or chlorinated hydrocarbons.

I claim:

1. A tape for locating fasteners on corresponding panels of material comprising a strip having a longitudinal perforation throughout its length, locating indicia on both sides of said perforation, the indicia on one side corresponding along the length of said tape to the indicia on the other side, coded markings adjacent said locating indicia to indicate alternative spacings between said indicia, and an adhesive on the surface of said tape opposite said indicia and said markings for temporarily adhering said tape to panels of material for locating pairs of fasteners on said panels, wherein the locating indicia on one side of said perforation comprise horizontal or vertical length marks.

2. A tape according to claim 1, wherein the tape strip is made of material which is disintegratible in water.

3. A tape according to claim 1, wherein the tape strip is made of material which is disintegratible in dry cleaning solvents.

* * * * *